US011259636B1

(12) United States Patent
Hsiao

(10) Patent No.: US 11,259,636 B1
(45) Date of Patent: Mar. 1, 2022

(54) SEAT

(71) Applicant: CHIA CHI YA ENTERPRISE CO., LTD., Tainan (TW)

(72) Inventor: Yun-Cheng Hsiao, Tainan (TW)

(73) Assignee: CHIA CHI YA ENTERPRISE CO., LTD., Tainan (TW)

( * ) Notice: Subject to any disclaimer, the term of this patent is extended or adjusted under 35 U.S.C. 154(b) by 0 days.

(21) Appl. No.: 17/130,897

(22) Filed: Dec. 22, 2020

(51) Int. Cl.

| | |
|---|---|
| ***A47C 7/02*** | (2006.01) |
| ***A47C 7/34*** | (2006.01) |
| *A47C 7/00* | (2006.01) |
| *A47C 3/24* | (2006.01) |

(52) U.S. Cl.
CPC ..... *A47C 7/024* (2013.01); *A47C 7/027* (2013.01); *A47C 7/347* (2013.01); *A47C 3/24* (2013.01); *A47C 7/004* (2013.01)

(58) Field of Classification Search
CPC ..... A47C 7/024; A47C 7/14; A47C 23/002; A47C 3/0252; A47C 7/144; A47C 7/443
USPC ..... 297/338, 339, 452.49, 452.5
See application file for complete search history.

(56) References Cited

U.S. PATENT DOCUMENTS

| | | | | |
|---|---|---|---|---|
| 2,799,323 A * | 7/1957 | Berg | ..... | A47C 3/025 297/312 |
| 3,058,778 A * | 10/1962 | Campbell | ..... | A47C 23/002 297/452.5 |
| 7,387,339 B2 * | 6/2008 | Bykov | ..... | A47C 7/443 297/312 |
| 11,116,319 B1 * | 9/2021 | Hsiao | ..... | A47C 7/024 |

* cited by examiner

*Primary Examiner* — Sarah B McPartlin
(74) *Attorney, Agent, or Firm* — Birch, Stewart, Kolasch & Birch, LLP

(57) ABSTRACT

A seat has a supporting frame being rigid, two seat cushions disposed above the supporting frame, and two supporting members. The supporting frame has a main body and four side bodies fixedly mounted on two front ends and two rear ends of the main body. The supporting members are mounted on bottom surfaces of the seat cushions and are connected to the supporting frame. Each one of the supporting members has multiple supporting elements respectively located at a front half section and a rear half section of a corresponding one of the seat cushions. Each one of the supporting elements has a guiding rod mounted on the supporting frame and a main spring disposed around the guiding rod. The seat provides good support by the supporting frame and the supporting members and provides a cushioning performance by the main spring.

19 Claims, 8 Drawing Sheets

SEAT

BACKGROUND OF THE INVENTION

1. Field of the Invention

The present invention relates to a seat, and more particularly to a seat with support and cushioning.

2. Description of Related Art

A conventional seat is mounted on legs of a chair and has a base and two sponge cushions. The base is mounted on the legs of the chair. The two sponge cushions are mounted on a top surface of the base. In use, the two sponge cushions respectively support a left hip and a right hip of a user. Deformations of the two sponge cushions may be different according to different pressures applied on the two sponge cushions for fitting the user. However, the support of the seat is only provided by the two sponge cushions and is insufficient.

For increasing the support of the conventional seat, another seat is applied and has the base, a seat cushion, and multiple oscillating members. The seat cushion is mounted on the base and has a board and a cushioning body mounted on the board. The oscillating members are mounted between the base and the seat cushion. Each one of the oscillating members has an oscillating plate, a first pivoted portion, and a second pivoted portion. The oscillating plate is located between the base and the board. The first pivoted portion is mounted on the oscillating plate and is tiltably connected to the base. The second pivoted portion is mounted on the oscillating plate and is tiltably connected to the base. When the sitting posture of the user is changed, the seat cushion can move relative to the base by the oscillating members. However, each one of the oscillating members can provide sufficient support by the first pivoted portion and the second pivoted portion, but cushioning performance of the oscillating members is not good.

For improving the cushioning performance, still another seat has the base, the seat cushion, and multiple buffer members. The seat cushion is mounted on the base and has the board and the cushioning body mounted on the board. The base has multiple assembling recesses and multiple positioning protrusions. The assembling recesses are formed on a bottom surface of the base. Each one of the positioning protrusions is formed on an inner-top surface of one of the assembling recesses. The buffer members are disposed in the assembling recesses. A bottom end of each one of the buffer members abuts against the base. A top end of each one of the buffer members abuts against the board around a corresponding one of the positioning protrusions. The buffer members can provide good cushioning performance. However, there is a gap formed between each one of the buffer members and a corresponding one of the assembling recesses. The bottom end of each one of the positioning protrusions does not protrude out of a bottom surface of the board. Thus, the positioning protrusions cannot effectively guide the buffer members to compress vertically. The buffer members are easy to laterally deviate excessively to decrease the support.

To overcome the shortcomings, the present invention provides a seat to mitigate or obviate the aforementioned problems.

SUMMARY OF THE INVENTION

The objective of the invention is to provide a seat that can solve the drawback that the support and the cushioning performance of the conventional seats are not good.

The seat of the present invention has a supporting frame, two seat cushions, and two supporting members. The supporting frame is rigid and has a main body and four side bodies. The four side bodies are fixedly mounted on two front ends and two rear ends of the main body respectively. Each one of the four side bodies has at least one through hole. The two seat cushions are disposed above the supporting frame and are laterally arranged. The two supporting members are mounted on bottom surfaces of the two seat cushions and are both connected to the supporting frame.

Each one of the two supporting members has multiple supporting elements. The supporting elements are respectively located at a front half section and a rear half section of a corresponding one of the two seat cushions. Each one of the supporting elements has a guiding rod and a main spring. The guiding rod is mounted on the supporting frame and has a head and a shank. The head is located on a bottom surface of the supporting frame. An outer diameter of the head is larger than a diameter of the at least one through hole. The shank is formed on the head, is movably inserted through one of the at least one through hole, and is screwed into the corresponding one of the two seat cushions. The main spring is disposed around the shank of the guiding rod. Two ends of the main spring respectively abut against one of the four side bodies and the corresponding one of the two seat cushions.

The supporting frame of the seat is mounted on legs of a chair by fastening elements. In use, a user's left hip and left thigh rest on one of the two seat cushions, and the user's right hip and right thigh rest on the other seat cushion. The two seat cushions move downwardly. In the movement of one of the supporting elements, the shank of the guiding rod moves downwardly relative to the supporting frame, and the main spring is compressed along an axial direction of the shank and is mounted around the shank to avoid deviation by the shank and to provide good support. The supporting elements of the two supporting members move relative to the supporting frame and abut against the supporting frame. The seat can assist in providing good support.

The supporting elements of each one of the two supporting members are respectively located at the front half section and the rear half section of the corresponding one of the two seat cushions. According to the difference of the user's sitting posture and the change of the pressures applied on the two seat cushions, the main spring of each one of the supporting elements can generate different degrees of compression and provide different degrees of supporting force to form a multi-point support configuration and to increase support effectively. The main spring can provide a cushioning performance simultaneously.

The seat provides good support by the supporting frame and the two supporting members, provides good cushioning performance by the two supporting members, and has both the support and the cushioning performance to improve sitting comfort.

Furthermore, in each one of the supporting elements, the shank of the guiding rod is screwed into the corresponding one of the two seat cushions. The guiding rod can be rotated according to the user's needs to adjust the support of the main spring for satisfying individual differences.

In addition, the four side bodies of the supporting frame are fixedly mounted on two front ends and two rear ends of the main body to simplify a structure of the supporting frame and ensure structural strength.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
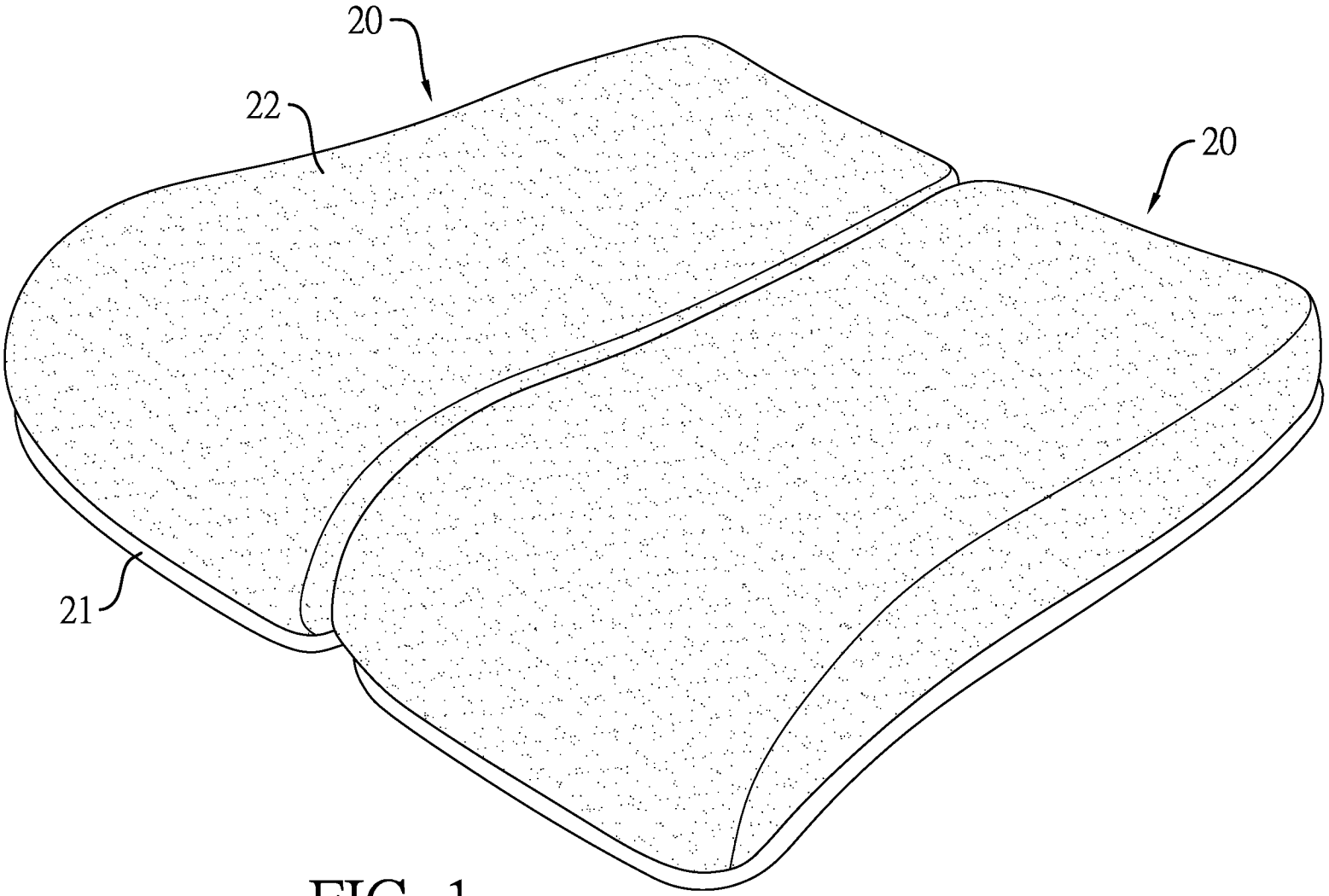
FIG. 1 is a perspective view of a first embodiment of a seat in accordance with the present invention.
Figure 2:
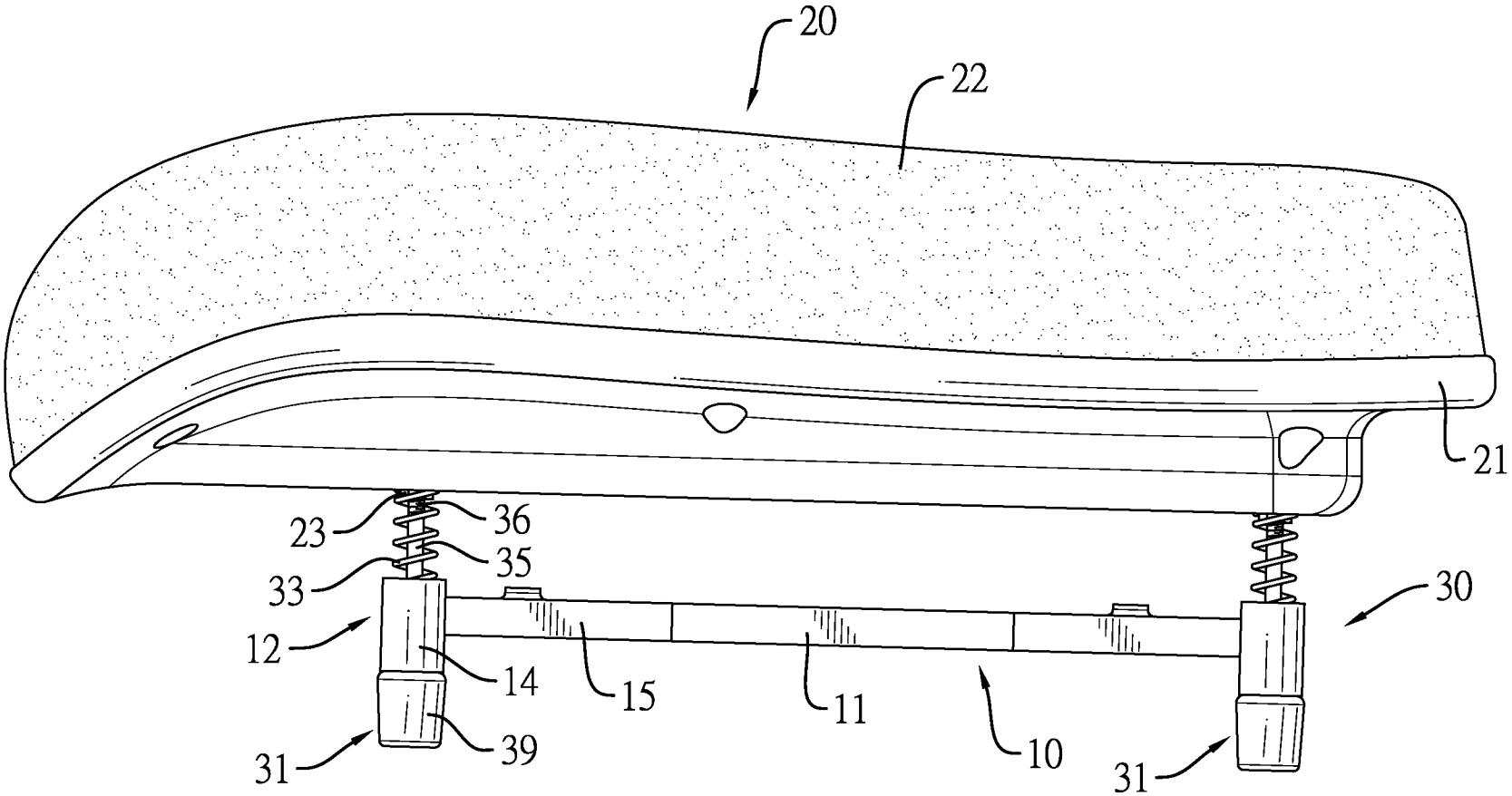
FIG. 2 is a side view of the seat in FIG. 1.

With reference to FIGS. 1 to 4, and 6, a seat in accordance with the present invention has a supporting frame 10, 10', two seat cushions 20, and two supporting members 30, 30'.

With reference to FIGS. 1 to 4, the supporting frame 10 is rigid and has a main body 11 and four side bodies 12. The four side bodies 12 are fixedly mounted on two front ends and two rear ends of the main body 11 respectively. Each one of the four side bodies 12 has at least one through hole 13. The main body 11 is rectangular.

The two seat cushions 20 are disposed above the supporting frame 10 and are laterally arranged. Each one of the seat cushions 20 has a bottom plate 21, a cushioning body 22, and multiple nuts 23. The bottom plate 21 is disposed above the supporting frame 10. The cushioning body 22 is mounted on a top surface of the bottom plate 21. The nuts 23 are mounted on a bottom surface of the bottom plate 21.

Figure 4:
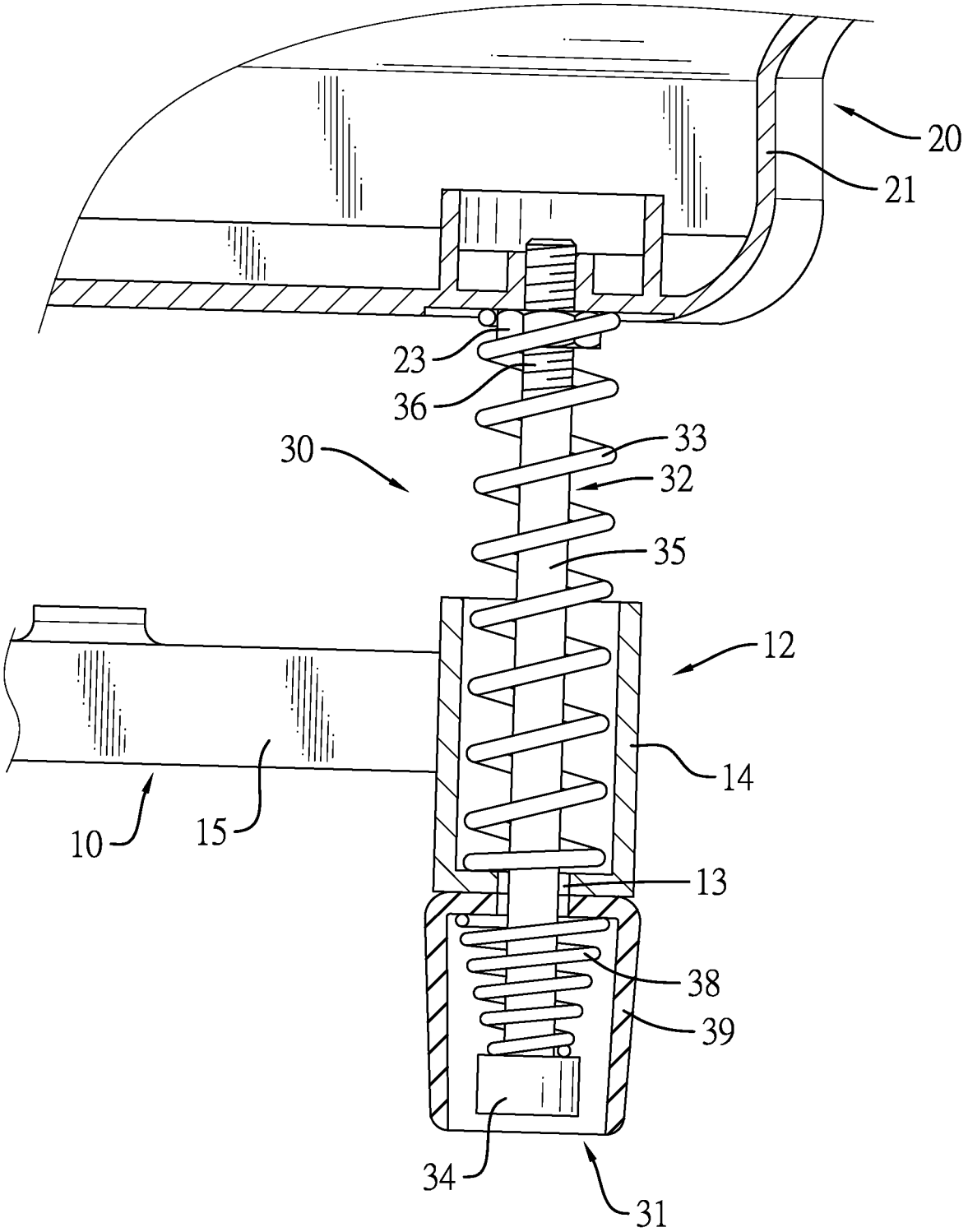
FIG. 4 is a cross sectional side view of the seat along line 4-4 in FIG. 3.

The two supporting members 30 are mounted on bottom surfaces of the two seat cushions 20 and are both connected to the supporting frame 10. Each one of the two supporting members 30 has multiple supporting elements 31. The supporting elements 31 are respectively located at a front half section and a rear half section of a corresponding one of the two seat cushions 20. Each one of the supporting elements 31 has a guiding rod 32 and a main spring 33. The guiding rod 32 is mounted on the supporting frame 10 and has a head 34 and a shank 35. The head 34 is located on a bottom surface of the supporting frame 10. An outer diameter of the head 34 is larger than a diameter of the at least one through hole 13. The shank 35 is formed on the head 34, is movably inserted through one of the at least one through hole 13, and is screwed into the corresponding one of the two seat cushions 20. The main spring 33 is disposed around the shank 35 of the guiding rod 32. Two ends of the main spring 33 respectively abut against one of the four side bodies 12 and the corresponding one of the two seat cushions 20. With reference to FIG. 4, the shank 35 has an outer threaded portion 36 formed around an outer surface of the shank 35. The shank 35 is screwed into a corresponding one of the nuts 23 by the outer threaded portion 36. The guiding rod 32 of each one of the supporting elements 31 has a tool hole 37 formed on a bottom surface of the head 34.

Figure 5:
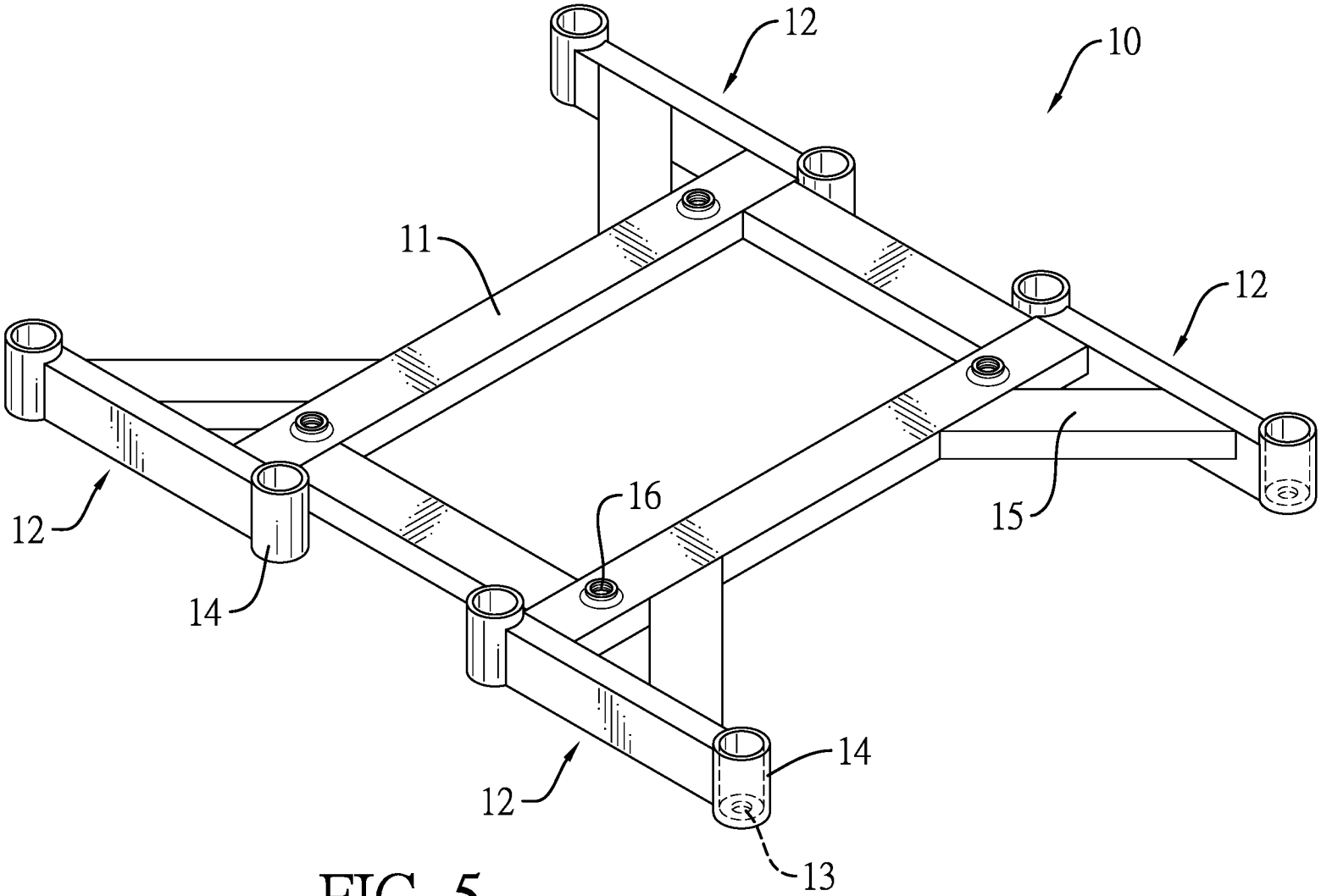
FIG. 5 is a perspective view of a supporting frame of the seat in FIG. 3.

With reference to FIG. 5, each one of the four side bodies 12 has at least one tube portion 14. The at least one through hole 13 is formed through an inner-bottom surface of the at least one tube portion 14. The supporting frame 10 has four reinforcement ribs 15. Two ends of each one of the four reinforcement ribs 15 respectively abut against the main body 11 and one of the four side bodies 12. The main body 11 has multiple connecting holes 16.

Figure 3:
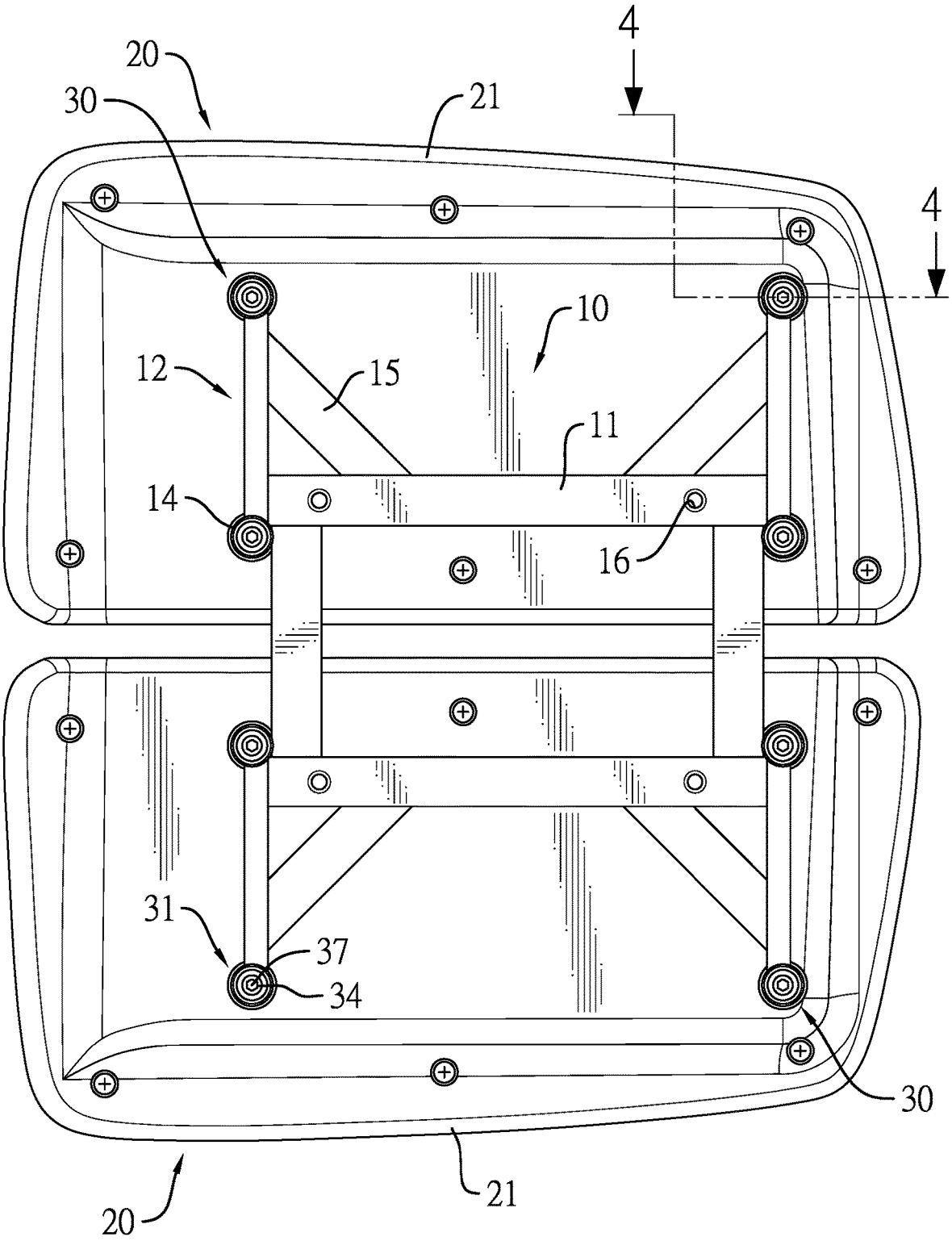
FIG. 3 is a bottom view of the seat in FIG. 1.

With reference to FIGS. 3 and 4, each one of the supporting elements 31 has a cushioning member 38. The cushioning member 38 is mounted around the shank 35 of the guiding rod 32 and is located between the head 34 of the guiding rod 32 and one of the at least one through hole 13. The cushioning member 38 is a conical spring. Each one of the supporting elements 31 has a protecting sleeve 39. The protecting sleeve 39 is mounted around the shank 35 of the guiding rod 32, is located below the main spring 33, and covers the cushioning member 38. The protecting sleeve 39 covers the cushioning member 38 and the head 34 of the guiding rod 32 to avoid colliding and damaging for improving the visual look.

Figure 6:
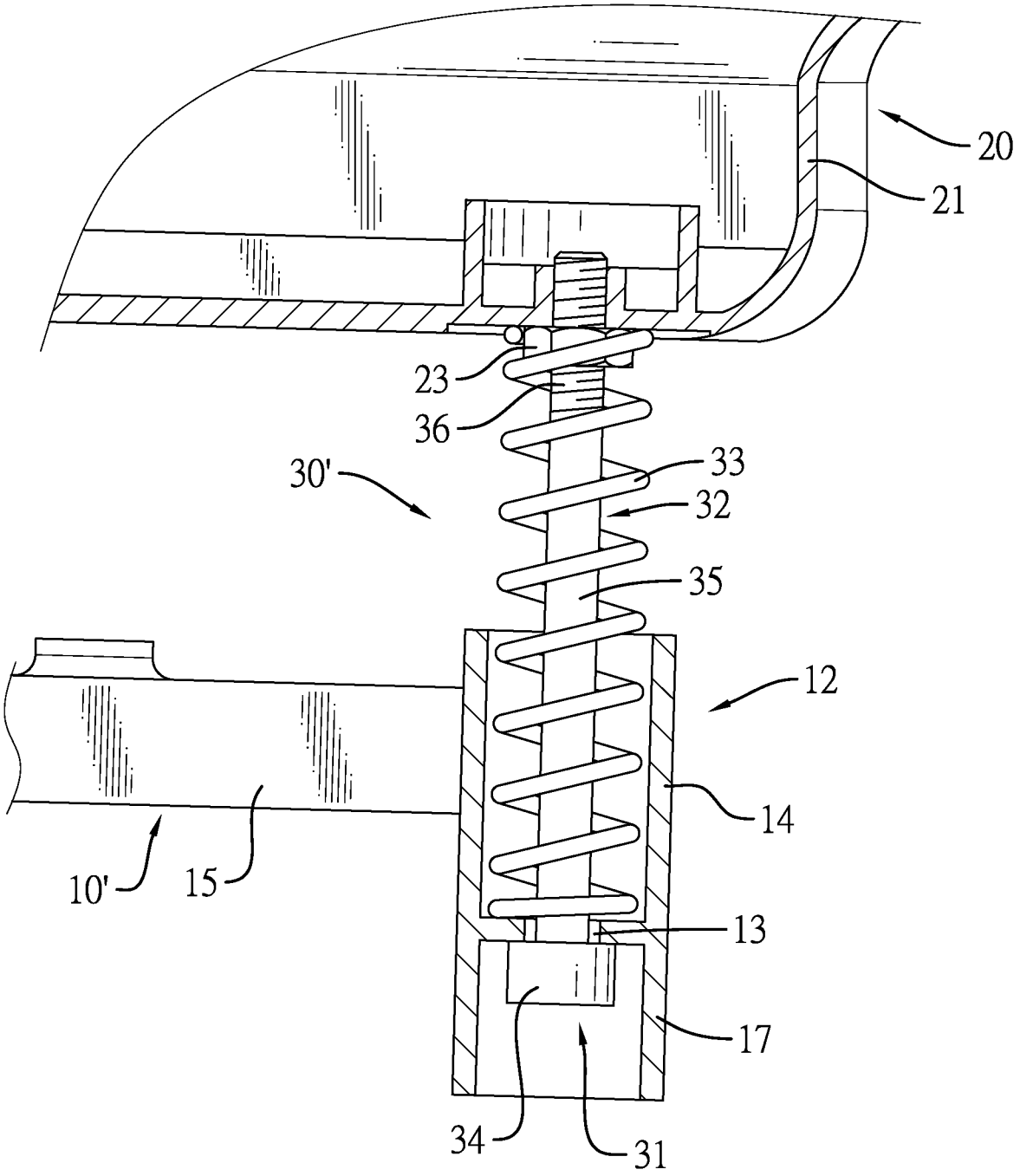
FIG. 6 is a cross sectional side view of a second embodiment of a seat in accordance with the present invention.

With reference to FIG. 6, each one of the four side bodies 12 has at least one bottom wall portion 17. The at least one bottom wall portion 17 is formed on an outer-bottom surface of the at least one tube portion 14 and extends downwardly. Each one of the at least one bottom wall portion 17 is disposed around the head 34 of the corresponding guiding rod 32.

A number of the at least one through hole 13 in each one of the four side bodies 12 is two. A number of the supporting elements 31 in each one of the supporting members 30 is four. Two of the four supporting elements 31 are disposed on the front half section of the corresponding one of the two seat cushions 20 and are laterally arranged. The other two of the four supporting elements 31 are disposed on the rear half section of the corresponding one of the two seat cushions 20 and are laterally arranged.

Figure 7:
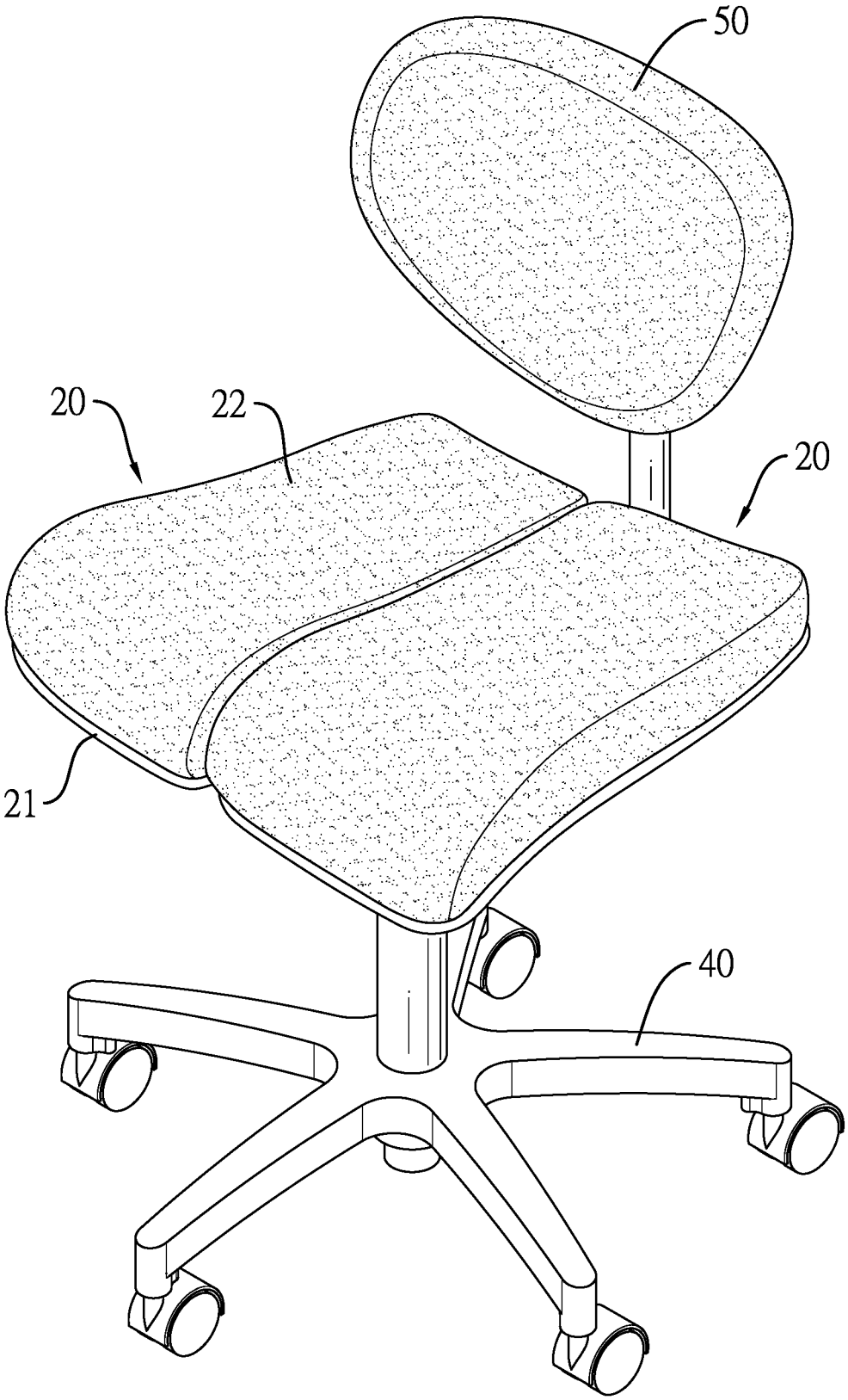
FIG. 7 is an operational perspective view of the seat in FIG. 1.

With reference to FIG. 7, the seat is mounted on legs 40 of a chair. A seat back 50 of the chair is mounted on the seat adjacent to a rear end of the supporting frame 10.

Figure 8:
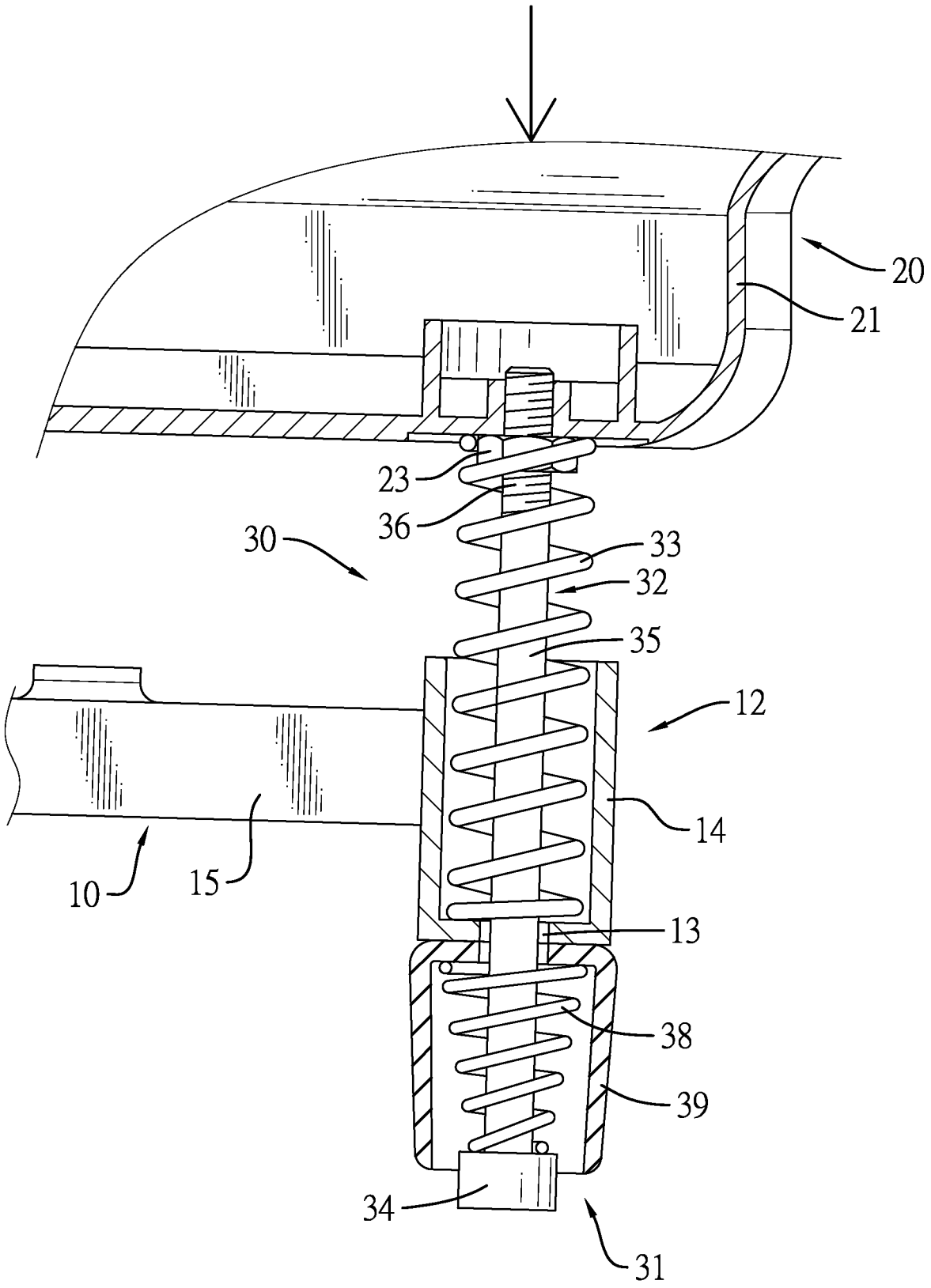
FIG. 8 is an operational and cross sectional side view of the seat in FIG. 4.

In use, a user's left hip and left thigh rest on one of the two seat cushions 20, and the user's right hip and right thigh rest on the other seat cushion 20. The rear half section of each one of the two seat cushions 20 is pressed by the user' hip. The front half section of each one of the two seat cushions 20 is pressed by the user' thigh. With reference to FIG. 8, the two seat cushions 20 are pressed by the user, move downwardly, and drive the guiding rods 32 of the supporting elements 31. In the movement of one of the supporting elements 31, the guiding rod 32 moves downwardly relative to the supporting frame 10 along a corresponding one of the at least one tube portion 14 to compress the main spring 33. The main spring 33 is compressed along an axial direction of the shank 35 and provides a support force. The main spring 33 is mounted around the shank 35. Degree of deviation of the main spring 33 is limited by the shank 35 to avoid excess of the deviation. The supporting elements 31 of the two supporting members 30 move relative to the supporting frame 10 and abut against the supporting frame 10. The seat can assist in providing good support.

The seat has the two seat cushions 20. The supporting elements 31 are located at the front half section and the rear half section of each one of the two seat cushions 20. Pressing forces of the user's hip and the user's thigh are different. The main springs 33 of the supporting elements 31 at different locations can generate different degrees of compression and provide different degrees of supporting force to form a multi-point support configuration and increase the support effectively. The supporting frame 10 is a rigid and integrated component for improving the support.

When the user's sitting posture and the pressing force are changed, and deformations of the main springs 33 of the supporting elements 31 are changed to immediately adjust the supporting force. The main spring 33 can provide the support and a cushioning performance.

Accordingly, the seat can provide good support by the supporting frame 10 and the supporting elements 31. The supporting elements 31 can form the multi-point support configuration to increase stability of the support. The main springs 33 can provide good cushioning performance. The cushioning members 38 can assist in increasing the cushioning performance. The seat has both the support and the cushioning performance to improve sitting comfort.

In addition, in each one of the supporting elements 31, the shank 35 of the guiding rod 32 is screwed into one of the two seat cushions 20. According to sitting postures and required supports of different users, the guiding rod 32 can be rotated to adjust the support of the main spring 33 for satisfying individual differences.

Furthermore, the four side bodies 12 of the supporting frame 10 are respectively and fixedly mounted on the two front ends and the two rear ends of the main body 11 to simplify a structure of the supporting frame 10 and ensure structural strength.

What is claimed is:

1. A seat comprising:

a supporting frame being rigid and having
- a main body; and
- four side bodies fixedly mounted on two front ends and two rear ends of the main body respectively, and each one of the four side bodies having at least one through hole;

two seat cushions disposed above the supporting frame and laterally arranged; and two supporting members mounted on bottom surfaces of the two seat cushions and both connected to the supporting frame, each one of the two supporting members having
- multiple supporting elements respectively located at a front half section and a rear half section of a corresponding one of the two seat cushions, and each one of the supporting elements having
  - a guiding rod mounted on the supporting frame and having
    - a head located on a bottom surface of the supporting frame, wherein an outer diameter of the head is larger than a diameter of the at least one through hole; and
    - a shank formed on the head, movably inserted through one of the at least one through hole, and screwed into the corresponding one of the two seat cushions; and
  - a main spring disposed around the shank of the guiding rod, and two ends of the main spring respectively abutting against one of the four side bodies and the corresponding one of the two seat cushions.

2. The seat as claimed in claim 1, wherein each one of the four side bodies has at least one tube portion; the at least one through hole is formed through an inner-bottom surface of the at least one tube portion.

3. The seat as claimed in claim 2, wherein the supporting frame has four reinforcement ribs, two ends of each one of the four reinforcement ribs respectively abut against the main body and one of the four side bodies.

4. The seat as claimed in claim 3, wherein the main body has multiple connecting holes.

5. The seat as claimed in claim 1, wherein each one of the supporting elements has a cushioning member, and the cushioning member is mounted around the shank of the guiding rod and is located between the head of the guiding rod and one of the at least one through hole.

6. The seat as claimed in claim 2, wherein each one of the supporting elements has a cushioning member, and the cushioning member is mounted around the shank of the guiding rod and is located between the head of the guiding rod and one of the at least one through hole.

7. The seat as claimed in claim 3, wherein each one of the supporting elements has a cushioning member, and the cushioning member is mounted around the shank of the guiding rod and is located between the head of the guiding rod and one of the at least one through hole.

8. The seat as claimed in claim 4, wherein each one of the supporting elements has a cushioning member, and the cushioning member is mounted around the shank of the guiding rod and is located between the head of the guiding rod and one of the at least one through hole.

9. The seat as claimed in claim 5, wherein each one of the supporting elements has a protecting sleeve, and the protecting sleeve is mounted around the shank of the guiding rod, is located below the main spring, and covers the cushioning member.

10. The seat as claimed in claim 6, wherein each one of the supporting elements has a protecting sleeve, and the protecting sleeve is mounted around the shank of the guiding rod, is located below the main spring, and covers the cushioning member.

11. The seat as claimed in claim 7, wherein each one of the supporting elements has a protecting sleeve, and the protecting sleeve is mounted around the shank of the guiding rod, is located below the main spring, and covers the cushioning member.

12. The seat as claimed in claim 8, wherein each one of the supporting elements has a protecting sleeve, and the protecting sleeve is mounted around the shank of the guiding rod, is located below the main spring, and covers the cushioning member.

13. The seat as claimed in claim 2, wherein each one of the four side bodies has at least one bottom wall portion, and the at least one bottom wall portion is formed on an outer-bottom surface of the at least one tube portion and extends downwardly.

14. The seat as claimed in claim 3, wherein each one of the four side bodies has at least one bottom wall portion, and the at least one bottom wall portion is formed on an outer-bottom surface of the at least one tube portion and extends downwardly.

15. The seat as claimed in claim 4, wherein each one of the four side bodies has at least one bottom wall portion, and the at least one bottom wall portion is formed on an outer-bottom surface of the at least one tube portion and extends downwardly.

16. The seat as claimed in claim 1, wherein a number of the at least one through hole in each one of the four side bodies is two; a number of the supporting elements in each one of the supporting members is four, two of the four supporting elements are disposed on the front half section of the corresponding one of the two seat cushions and are laterally arranged; the other two of the four supporting elements are disposed on the rear half section of the corresponding one of the two seat cushions and are laterally arranged.

17. The seat as claimed in claim 2, wherein a number of the at least one through hole in each one of the four side bodies is two; a number of the supporting elements in each one of the supporting members is four, two of the four supporting elements are disposed on the front half section of the corresponding one of the two seat cushions and are laterally arranged; the other two of the four supporting elements are disposed on the rear half section of the corresponding one of the two seat cushions and are laterally arranged.

18. The seat as claimed in claim 3, wherein a number of the at least one through hole in each one of the four side bodies is two; a number of the supporting elements in each one of the supporting members is four, two of the four supporting elements are disposed on the front half section of the corresponding one of the two seat cushions and are laterally arranged; the other two of the four supporting elements are disposed on the rear half section of the corresponding one of the two seat cushions and are laterally arranged.

19. The seat as claimed in claim 4, wherein a number of the at least one through hole in each one of the four side bodies is two; a number of the supporting elements in each one of the supporting members is four, two of the four supporting elements are disposed on the front half section of the corresponding one of the two seat cushions and are laterally arranged; the other two of the four supporting elements are disposed on the rear half section of the corresponding one of the two seat cushions and are laterally arranged.

* * * * *